US006234852B1

(12) United States Patent
Kato

(10) Patent No.: US 6,234,852 B1
(45) Date of Patent: May 22, 2001

(54) IMPELLER FOR WATER JET PUMP OF WATERCRAFT

(75) Inventor: Hironori Kato, Akashi (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 0 days.

(21) Appl. No.: 09/417,862

(22) Filed: Oct. 14, 1999

(30) Foreign Application Priority Data

Oct. 15, 1998 (JP) ..... 10-293850

(51) Int. Cl.[7] ..... B63H 11/08

(52) U.S. Cl. ..... 440/38; 416/244 B; 416/245 A; 440/49

(58) Field of Search ..... 440/38, 40–44, 440/49; 416/244 B, 245 A

(56) References Cited

U.S. PATENT DOCUMENTS 5,451,143 * 9/1995 Lin ..... 416/244 B
5,695,370 * 12/1997 Lin ..... 416/244 B
5,759,074 * 6/1998 Jones ..... 416/244 B
5,871,381 * 2/1999 Lin ..... 440/38
6,024,615 * 2/2000 Eichinger ..... 440/38

FOREIGN PATENT DOCUMENTS 2513811 7/1996 (JP) ..... F04D/29/22

* cited by examiner

*Primary Examiner*—Sherman Basinger

(57) ABSTRACT

An impeller for a water jet pump of a watercraft having a structure so as to enhance pump efficiency, and to reduce manufacturing cost having a tip portion configured to be fixed to a propeller shaft for being rotated integrally with the propeller shaft, and a rear end portion configured to be fixed to a pump shaft configured for being rotated in a pump casing. An upstream tip portion defines a spline hole which is formed directly in said tip portion of the impeller, the spline hole being configured for coupling to a spline shaft portion of the propeller shaft, the impeller further including a fitting hole which is formed on a rear end portion of the impeller configured for fitting a cylindrical member therein, and a cylindrical member is included having an outer periphery which can be fitted in the fitting hole and a female screw threads on an inner peripheral face configured for connection to the pump shaft are also provided.

4 Claims, 6 Drawing Sheets

IMPELLER FOR WATER JET PUMP OF WATERCRAFT

BACKGROUND OF THE INVENTION

1. Field of the Invention

The invention relates to an impeller for a water jet pump of a watercraft, and more particularly to an attaching structure of a pump shaft side of the impeller and a propeller shaft side thereof.

2. Description of the Related Art

A watercraft which is propelled by a water jet pump, for example, a personal watercraft (which is also referred to as a "PWC") is configured to suck water (including sea water) through a water intake hole provided on a bottom of a hull. The water jet pump pressurizes the water and ejects the water rearward from the hull through an outlet port of the water jet pump, thereby advancing the PWC.

The water jet pump structure includes an impeller, which is rotatably provided in a pump casing, the inner periphery of which is circular-shaped. The impeller has a base portion shaped rather like a cone with its tip cut off (a frustum of a cone), that is, a "bullet shape," with blades provided on the outer periphery of the base portion. That is to say, the outer shape of the base portion is smaller on a tip side (upstream, or propeller shaft, side) and gradually becomes larger toward a more rearward portion. The blades (fins) are projected with a pitch angle to forcibly discharge water rearward on an outer peripheral portion of the base portion.

The tip portion of the base of the impeller is connected to a rear end of the propeller shaft on the engine (upstream) side so as to be rotated integrally with the propeller shaft. A rear (downstream) end of the impeller is connected to a tip portion of a pump shaft, so as to be rotated with the propeller shaft and the pump shaft.

The water sucking (front, or upstream) side of the water jet pump is connected to a water sucking (intake) passage having a water intake formed on the bottom of the hull. A pump nozzle, incorporating an outlet port of the water jet pump, has a cross-sectional area gradually reduced rearward. Consequently, water pressurized by the impeller is discharged at a high speed through the outlet port of the pump nozzle positioned at the rear end of the watercraft. Thus, the watercraft can advance by means of a water jet reaction force.

The portion of the impeller connecting to the propeller shaft comprises a spline hole formed in the tip portion of the impeller, and accommodates spline teeth formed on a rear-end portion of the propeller shaft such that the propeller shaft can be spline-connected to the spline hole. A connecting portion of the impeller to the pump shaft comprises a female screw-threaded hole formed in a rear end portion of the impeller. A male screw-threaded portion provided on a tip portion of the pump shaft is provided such that it can be screwed to the female screw hole.

In the prior art, the following techniques, described with reference to FIGS. 5 and 6, are known for providing connecting portions of the propeller shaft (upstream) side, and the pump shaft (downstream) side of an impeller.

More specifically, an impeller 1 shown in FIG. 5 which has been described in Japanese Utility Model No. 2513811, has a spline hole 1*b* and a female screw hole 1*d* provided on an impeller 1 itself, respectively. The spline hole 1*b* is provided by forming spline grooves one by one at predetermined intervals on the inner peripheral face of a prepared hole that is drilled before, by using a machine tool which is referred to as a "slotter." The female screw hole 1*d* is provided by forming a female screw 1*m* on the inner peripheral face of a prepared hole that is drilled, by using a machine tool which is referred to as a "tapper" or the like. An impeller manufactured by such a technique requires considerable working time. A special jig having a complicated shape, or the like, for setting (holding) is required. Consequently, the manufacturing cost of an impeller has increased.

With a structure such as is shown in FIG. 6, a spline hole 1*b* is formed beforehand in a cylindrical member 1Y by using a "broaching machine". A fitting hole 1*y* for fitting the cylindrical member 1Y therein is formed on the tip side portion of the impeller 1 and a prepared hole for a female screw is formed in the rear end of the impeller. A female screw-thread 1*m* is applied to the prepared hole for forming the female screw by means of the "tapper", and the cylindrical member 1Y is then fitted in the fitting hole 1*y* on the tip side portion of the impeller 1.

The impeller manufactured by such a technique is made with greater working efficiency than the impeller shown in FIG. 5. However, an outside diameter $d_1$ of the tip portion of the impeller is increased, so that the pump efficiency of the impeller is reduced.

SUMMARY OF THE INVENTION

In consideration of the foregoing circumstances it is an object of the invention to provide an impeller for a water jet pump of a watercraft having a structure such that the pump has a high efficiency, and also so that manufacturing work can be performed easily, and the manufacturing cost can be reduced.

A first aspect of the invention is directed to an impeller for a water jet pump of a watercraft, having a tip portion configured to be affixed to a propeller shaft extending from the engine to a water jet pump upstream side, for rotating integrally with the propeller shaft, and a rear end portion configured to be fixed to a pump shaft rotatable in a pump casing, comprising:

splines disposed in a spline hole formed in a tip portion of the impeller, configured for being coupled to a spline shaft portion of the propeller shaft;

structure defining a fitting hole formed in a rear end portion of the impeller, configured for fitting a cylindrical member therein; and a cylindrical member having an outer periphery, configured to be fitted into the fitting hole, defining a female screw thread on an inner peripheral face, configured for coupling to the pump shaft.

In a more detailed aspect in accordance with the impeller for a water jet pump of a watercraft having such a structure, a prepared hole for forming the spline hole is provided in the tip portion of the impeller and the fitting hole for fitting the cylindrical member therein. The spline hole is directly formed in the impeller itself. Therefore, the outside diameter of the tip portion of the impeller can be reduced, and a high pump efficiency obtained. The spline hole can be formed in the prepared hole easily and efficiently in a short amount of time by means of a broaching machine.

In the impeller for the water jet pump, it is preferable that the fitting hole is provided concentrically (coaxially) with the spline hole, and that the fitting hole and the spline hole communicate with each other. The fitting hole has a larger diameter than that of the spline hole, so that an inner peripheral wall of the fitting hole is positioned on an outer periphery of the spline hole in a portion where these holes communicate. In accordance with this configuration, a structure suitable for forming the spline hole by broaching is obtained.

In another more detailed aspect, in an impeller for the water jet pump in accordance with principles of the invention, furthermore, it is preferable that a buffer member configured for elastically abutting against an end (a rear end) of the propeller shaft is provided between the spline hole and the fitting hole. According to this structure, axial positioning (setting) for coupling of a crankshaft of an engine and the propeller shaft can be performed accurately and elastically.

In a further more detailed aspect, in the impeller for the water jet pump, moreover, it is preferable that provision be made for a connecting (transitioning) grommet for connecting (transitioning) an outer peripheral face surface of the propeller shaft to an outer peripheral face surface on a tip of the impeller to form a continuous face at the tip (upstream) end of the impeller. In accordance with this structure, it is possible to obtain a preferable structure with functions to cause water to smoothly flow in the water jet pump, and to enhance the pump efficiency.

These objectives as well as other features and advantages of the present invention will become more apparent to those skilled in the art from the following description with reference to the accompanying drawings.

DETAILED DESCRIPTION OF THE PREFERRED EMBODIMENT(S)

An impeller for a water jet pump of a watercraft in an embodiment in accordance with principles of the invention will be described below with reference to the drawings, taking an impeller for a water jet pump of a personal watercraft as an example.

Figure 1:
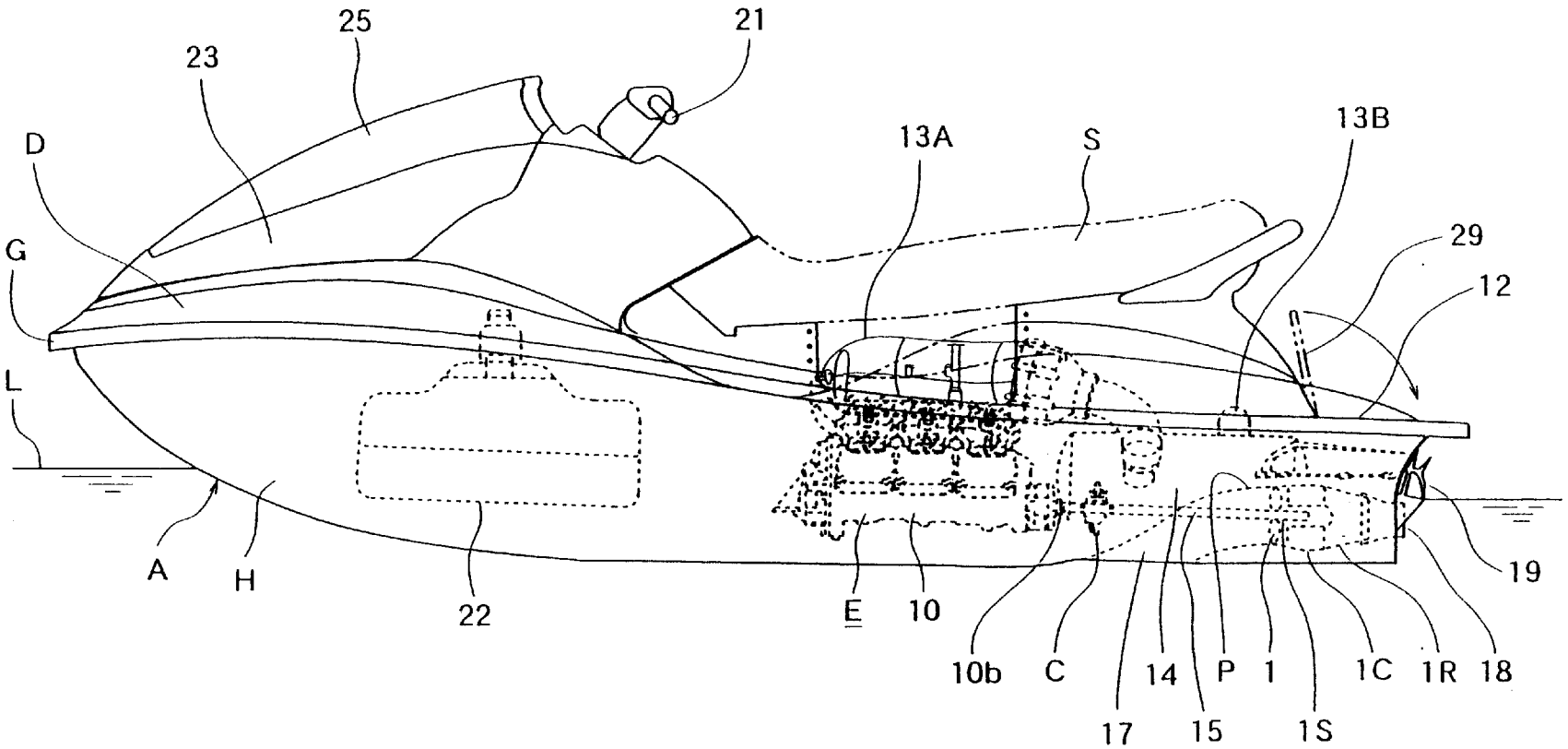
FIG. 1 is a side elevation view, showing a personal watercraft having a water jet pump provided with an impeller according to an embodiment of the invention.
Figure 2:
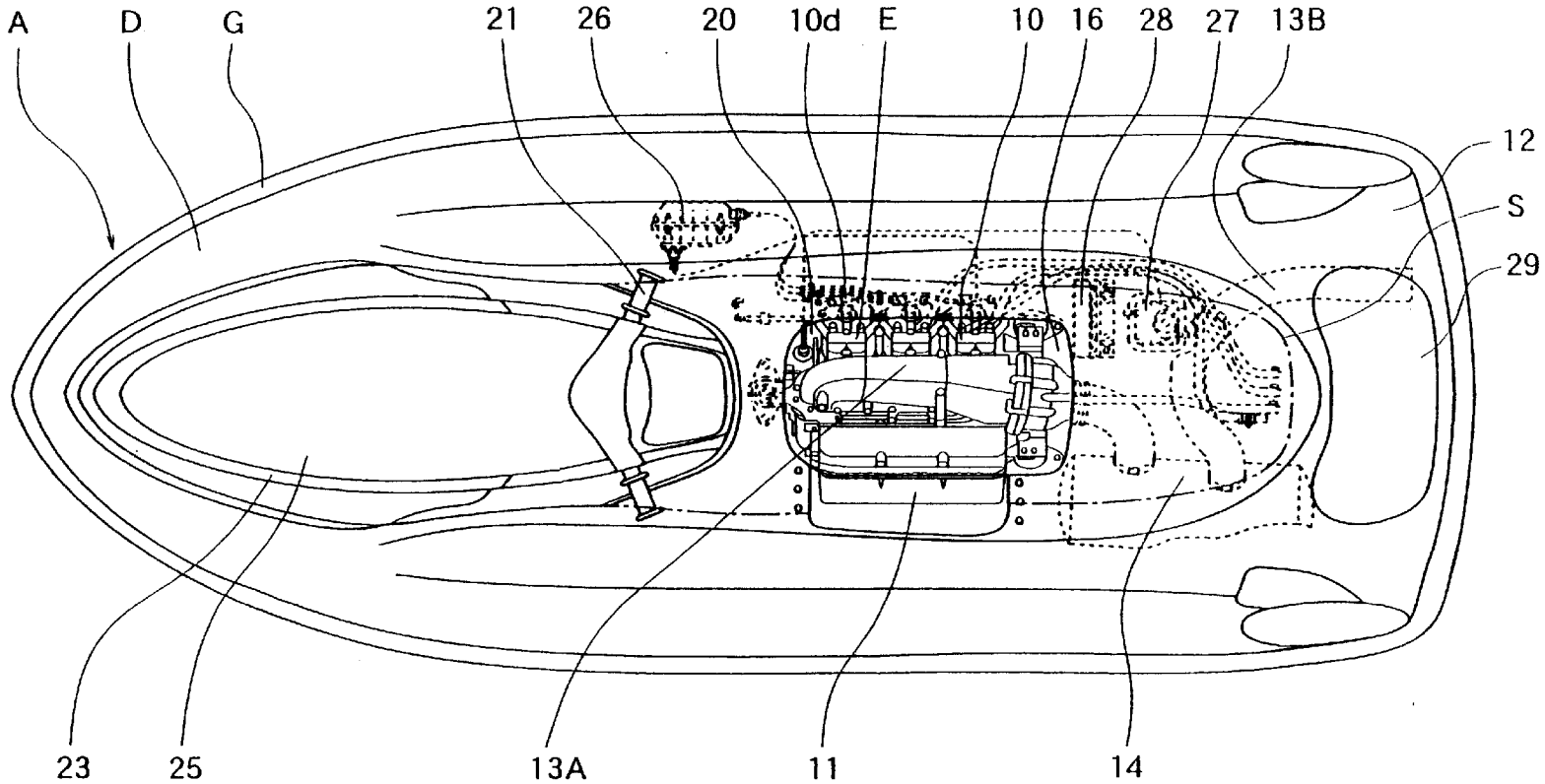
FIG. 2 is a plan view showing the personal watercraft illustrated in FIG. 1.

In FIGS. 1 and 2, A denotes a body of the personal watercraft. The body A comprises a hull H and a deck D covering an upper portion of the hull H. A line for connecting the hull H to the deck D over the entire periphery is referred to as a gunwale line G. In the illustrated embodiment, the gunwale line G is positioned above a waterline L of the personal watercraft.

An opening 16 having a top face that is almost rectangular as seen in a plane view along the longitudinal direction of the body A is formed slightly behind the center of the deck D as shown in FIG. 2. As shown in FIGS. 1 and 2, a riding seat S is provided above the opening 16.

An engine E is provided in a space (referred to as an "engine space") 20 having a convex cross-sectional shape surrounded by the hull H and the deck D below the seat S.

Figure 3:
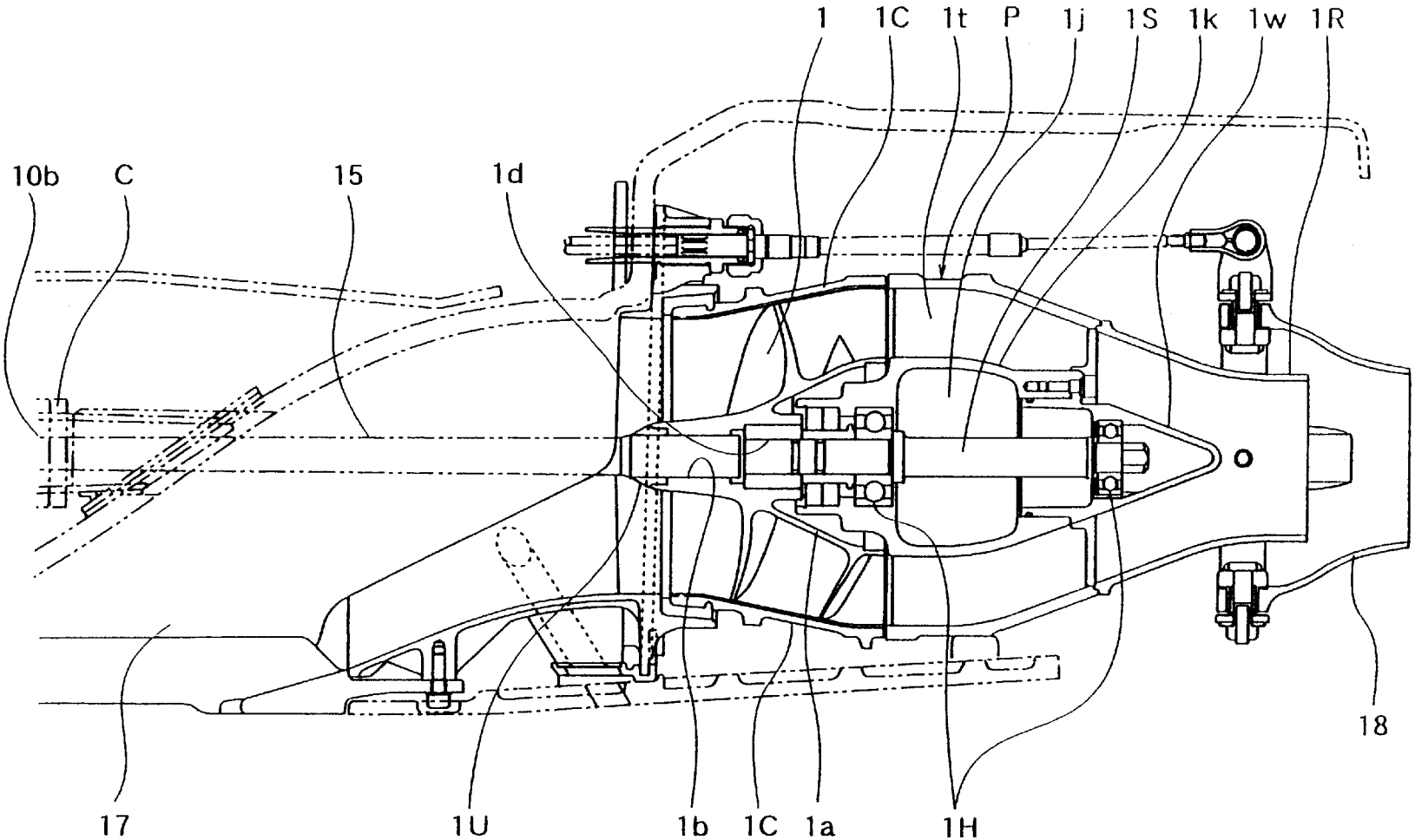
FIG. 3 is an enlarged view showing in more detail the structure of the water jet pump illustrated in FIG. 2.

The engine E is a multi-cylinder (three-cylinders in the embodiment) engine E. As shown in FIG. 1, a crankshaft 10*b* of the engine E is mounted in the longitudinal direction of the body A. As shown in FIG. 2, a carburetor 11 and an air intake chamber (not shown) connected thereto are provided on the left side of an engine block 10 (the port side, or left board, of the personal watercraft). As shown in FIGS. 1 and 2, an exhaust pipe 13A is provided above the engine block 10. The exhaust pipe 13A is connected to a silencer 14 provided at the oblique left side portion behind the engine block 10. An exhaust pipe 13B having a terminal reaching the outside of the rear end of the body A from the silencer 14 is provided above a water jet pump P. As shown in FIGS. 1 and 3, an output end of the crankshaft 10*b* projecting from the rear portion of the engine block 10 is rotatably coupled integrally with the tip portion of an impeller 1 of the water jet pump P through a propeller shaft 15. Furthermore, the rear end portion of the impeller 1 is coupled integrally with a pump shaft 1S of the water jet pump P. The impeller 1 is covered with a pump casing 1C on the outer periphery thereof. The water pump P sucks water from a water intake (water feeding port) 17 provided on the bottom of a hull through a water intake passage, and pressurizes and accelerates the water. The pressurized and accelerated water is ejected from a outlet port provided on the rear end of a pump nozzle 1R having a cross-sectional area of flow gradually reduced rearward, thereby obtaining propulsive force. In FIGS. 1 and 2, the reference numeral 21 denotes a steering handle. By operating the handle 21 right and left side, a steering nozzle 18 provided behind the pump nozzle 1R is swung from right side to left side so that steering can be performed in a desired direction. A deflector 19 for reverse (see FIG. 1) is provided above the rear side of the steering nozzle 18 such that it can be swung downward around a swinging shaft provided horizontally. By swinging the bowl-shaped deflector 19 down toward a lower position behind the steering nozzle 18, the water to be discharged rearward from the steering nozzle 18 is turned forward. Consequently, the personal watercraft can go astern.

In FIGS. 1 and 2, the reference numeral 12 denotes a rear deck. The rear deck 12 is provided with an openable hatch cover 29. A housing box having a small capacity is formed under the hatch cover 29. In FIG. 1, the reference numeral 22 denotes a fuel tank for supplying fuel to the engine E, and the reference numeral 23 denotes a front hatch cover. A box (not shown) for housing fittings and the like is provided under the hatch cover 23. Another hatch cover 25 is provided over the front hatch cover 23, thereby forming a double hatch cover. A life jacket and the like can be housed under the hatch cover 25.

In FIG. 2, the reference numeral 26 denotes an ignition device for supplying high voltage electricity to an ignition plug 10*d* of the engine E in a proper timing, the reference numeral 27 denotes an oil tank, and the reference numeral 28 denotes a battery.

Figure 4:
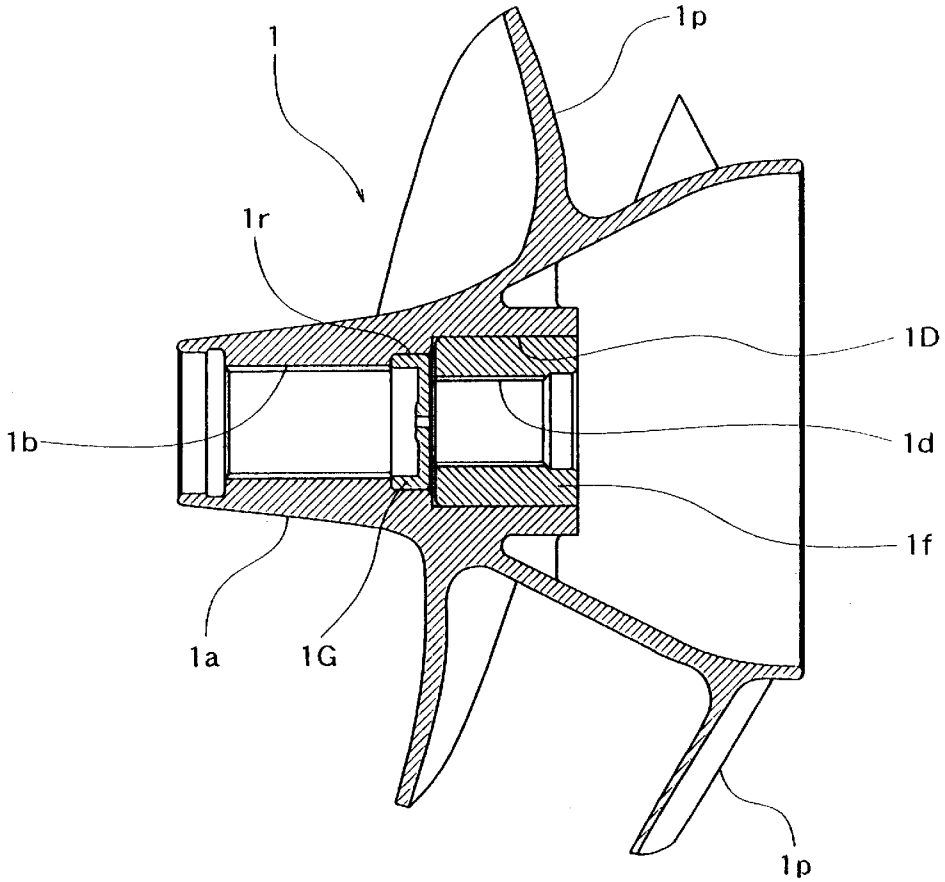
FIG. 4 is an enlarged sectional side view showing the impeller used in the water jet pump illustrated in FIG. 3.
Figure 5:
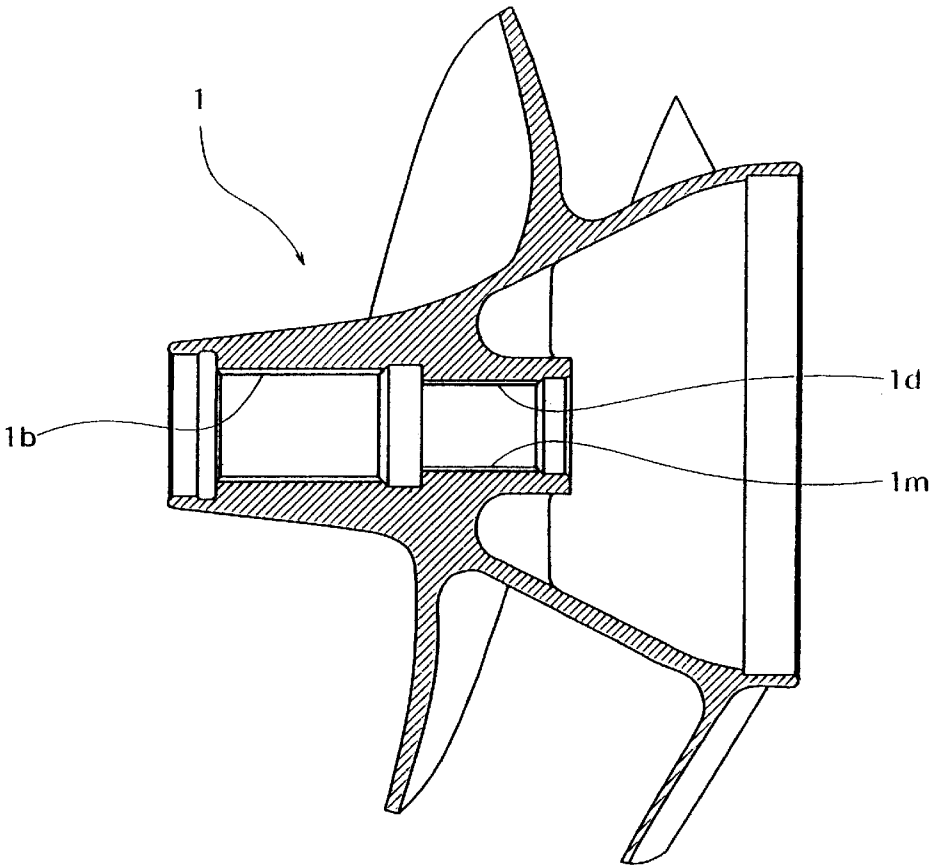
PRIOR ART Fig.5
FIG. 5 is an enlarged sectional side view showing the structure of a prior impeller water jet pump according to Japanese Utility Model No. 2513811.
Figure 6:
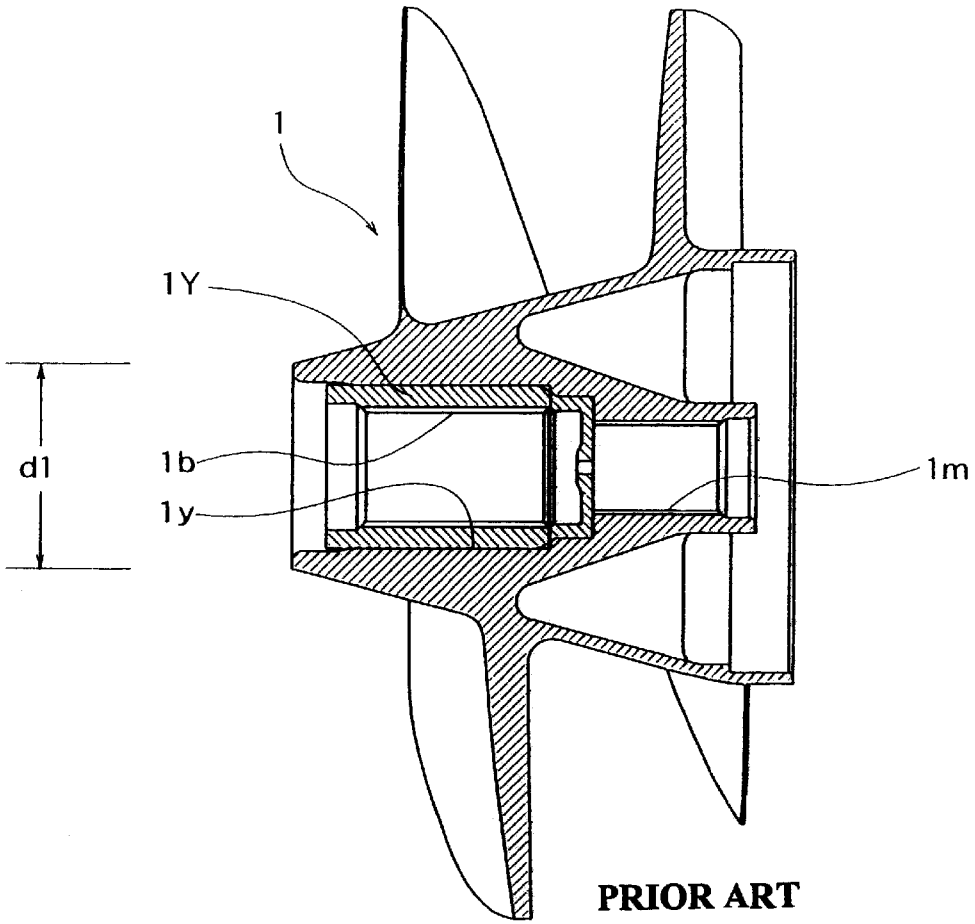
PRIOR ART Fig.6
FIG. 6 is an enlarged sectional side view showing the structure of another prior impeller of a water jet pump in accordance with the prior art.

With reference to FIGS. 3 and 4, the impeller 1 of the water jet pump P according to an embodiment of the invention has the following structure. The impeller 1 is formed by machining iron castings made of stainless steel. A base portion 1*a* of an impeller 1 has a tip cut conical shape (which is obtained by cutting away a tip from a conical shape), and has a so-called "bullet" shape having the cross section of whose diameter is gradually increased rearward and whose cross sections are circular. Blades 1*p* are provided with a pitch angle to feed water rearward on the outer periphery of the base portion 1*a* of the impeller 1.

A spline hole 1*b*, for connecting a propeller shaft for transmitting out put from the engine, is formed in the rotation center portion of the tip portion of the impeller 1, and a female screw hole 1*d* is provided concentrically with the spline hole 1*b* in the rotation center portion of the rear end portion of the impeller 1. A fitting hole 1D having a larger diameter than the outside diameter of the spline hole 1*b* is formed concentrically with the spline hole 1*b*. A cylindrical member 1*f* having a female screw hole 1*d* is fitted in the fitting hole 1D. Thus, the female screw hole 1*d* is formed. An inner peripheral wall of the fitting hole 1D is formed to be positioned on the outer periphery side of the inner peripheral wall of the spline hole 1*b*. The cylindrical member 1*f* having a female screw 1*m* formed on the inner periphery is pressed and fitted in the fitting hole 1D.

An impeller 1 in accordance with principles of the invention has the above-mentioned structure. Such an impeller 1 can be manufactured more easily with a reduction in working man-hours as compared with the prior art. For example, the first prepared hole of the spline hole 1*b* and the fitting hole 1D are formed concentrically on a work piece being the impeller 1, which is cast and has a peripheral edge machined in such a manner that both holes communicate with each other to cause the fitting hole 1D to have a larger diameter than the diameter (accurately, "major diameter") of the prepared hole of the spline hole 1*b*. The spline hole 1*b* is then formed in the prepared hole thereof by broaching using a broaching machine. The prepared hole of the spline hole 1*b* and the fitting hole 1D communicate with each other concentrically in such a manner that the fitting hole 1D has a larger diameter than the diameter of the prepared hole of the spline hole 1*b*. Therefore, the spline hole 1*b* can easily be formed by using the broaching machine.

The cylindrical member 1*f* which is separately manufactured with a female screw 1*m* on the inner periphery, has the same outside diameter as the diameter of the fitting hole 1D (accurately, the outside diameter is smaller than the diameter of the fitting hole 1D by a "fitting margin") is pressed and fitted in the fitting hole 1D by using a hydraulic equipment (hydraulic press) or the like. In place of the press fitting, the cylindrical member 1*f* can also be fitted in the fitting hole 1D by "shrinkage fit", "cooling fit" or the like. It may be fixed them with an adhesive material, welding or the like also.

The impeller 1 thus manufactured is fitted in the water jet pump P in the following manner. As shown in FIG. 3, a male screw (not shown) formed in the tip portion of the pump shaft 1S of the water jet pump P is screwed into the female screw hole 1*d* formed on the rear end portion of the impeller 1. The pump shaft 1S is rotatably supported by means of two ball-bearings 1H which are provided apart from each other axially in the rear side of the impeller 1. A space 1*j* is formed on the outer periphery of the pump shaft 1S and between the two ball-bearings 1H. A cylindrical portion 1*k* is formed on the outside of the space 1*j*. The cylindrical portion 1*k* has a face formed so as form a surface continuous with the outer peripheral face of the rear end of the base portion 1*a* of the impeller 1, and has a diameter gradually reduced on the rear end side. A stationary blade (fairing blade) it having a pitch angle is provided between an outer peripheral face of the cylindrical portion 1*k* and an inner peripheral face of the pump casing 1C. A fairing cone 1*w* is provided behind the cylindrical portion 1*k*. The fairing cone 1*w* is connected to the rear end of the cylindrical portion 1*k* and forms a wholly circular cone shape. The base portion 1*a* of the impeller 1, the cylindrical portion 1*k* and the fairing cone 1*w* form a shape when assembled so that a middle portion thereof is tumescent and gradually becomes smaller toward both end portions. That is to say, the shape(form) is a so-called "teardrop". An inner peripheral wall of the pump casing 1C of the water jet pump P is formed similar to the above shape. Such a shape and configuration as a whole contributes to the fact that water passing through the inside of the water jet pump P is efficiently pressurized and accelerated and ejected through the pump nozzle 1R provided in the rear end of the pump P.

The spline shaft formed on the rear end portion of the propeller shaft 15 is inserted with the spline hole 1*b* on the tip portion of the impeller 1, and both are spline-connected. As described above, the spline hole 1*b* is directly formed in the tip portion of the impeller 1. In this state, therefore, the outside diameter of the tip portion of the impeller 1 is not particularly increased as compared with the outside diameter of the propeller shaft 15. Moreover, a tapered connecting grommet 1U made of hard rubber is provided in the tip of the base portion 1*a* of the impeller 1 in such a manner that the propeller shaft 15 and the outer peripheral face of the impeller 1 are connected to form a continuous face. A hole 1*r* having a diameter increased slightly more than the diameter (or "major diameter") of the prepared hole of the spline hole 1*b* is formed between the rear end of the spline hole 1*b* and the front end of the fitting hole 1D. A buffer member 1G made of slightly soft rubber is provided in the hole 1*r*. The buffer member 1G is provided to perform axial positioning (setting), with an elastic action, of the couplings C (see FIGS. 1 and 3) placed between the tip of the propeller shaft 15 and the output end of the rankshaft 10*b* on the engine E.

The impeller 1 of an exemplary embodiment of the invention has the above-mentioned structure and can be manufactured in the above-mentioned manner. Therefore, the tip of the base portion 1*a* of the impeller 1 can have a small outside diameter which approximates the outside diameter of the propeller shaft 15. Consequently, water can be made to flow more smoothly in the water jet pump thereby increasing pump efficiency. In addition, the spline hole can be formed by using a broaching machine. Therefore, working time and labor man-hours can be reduced. Furthermore, the female screw is formed of a separate member in the fabrication process. This allows the material working creating a female screw thread to be performed separately from working of the impeller 1, further increasing manufacturing efficiently. As a result, the manufacturing cost of an impeller can be reduced. For the material working to form the female screw, it is not necessary to use a special jig for fixing of the impeller 1, which is a requirement in the prior art.

While a personal watercraft has been described with regard to the abovementioned exemplary embodiment, it will be apparent to one skilled in the art that the invention can also be applied to an impeller of a watercraft having a larger size.

Numerous modifications and alternative embodiments of the present invention will be apparent to those skilled in the art in view of the foregoing description. Accordingly, this description is to be construed as illustrative only, and is provided for the purpose of teaching those skilled in the art the best mode of carrying out the invention. The details of the structure and/or function may be varied substantially without departing from the spirit of the invention and all modifications which come within the scope of the appended claims are reserved.

I claim:

1. An impeller for a water jet pump of a watercraft having separate and coaxial propeller and pump shafts, the impeller having an upstream portion configured to be fixed to the propeller shaft which is connected to an engine of said watercraft and has a spline shaft portion at a free end thereof, and a downstream portion configured to be fixed to the pump shaft which is mounted for rotation in a pump casing of said watercraft and has a threaded free end thereof having screw threads, said impeller comprising:

a tip portion defining a spline hole formed directly in the tip portion of the impeller configured for coupling to said spline shaft portion of the propeller shaft;

a rear end portion defining a fitting hole formed in the rear end portion of the impeller; and a cylindrical member having an outer periphery which is configured to be fitted into the fitting hole, said cylindrical member defining a female screw hole having screw threads on an inner peripheral face configured for coupling to said screw threads of said free end of said pump shaft, whereby said impeller is mounted to and connects said propeller shaft and said pump shaft.

2. An impeller for a water jet pump in accordance with claim 1, wherein the fitting hole is provided concentrically with the spline hole, the fitting hole and the spline hole communicating with each other, and the fitting hole having a larger diameter than a diameter of the spline hole, so as to position an inner peripheral wall of the fitting hole on an outer periphery of the spline hole in a portion where these holes communicate.

3. An impeller for a water jet pump of a watercraft, the impeller having an upstream portion configured to be fixed to a spline shaft portion of a propeller shaft connected to an engine, the impeller being configured for rotating integrally with the propeller shaft, and the impeller having a downstream portion configured to be fixed to a pump shaft for rotation in a pump casing, comprising:

a tip portion defining a spline hole formed directly in the tip portion of the impeller configured for coupling to a spline shaft portion of the propeller shaft;

a rear end portion defining a fitting hole formed in the rear end portion of the impeller;

a cylindrical member having an outer periphery which is configured so that it can be fitted into the fitting hole, said cylindrical member defining a female screw hole having screw threads on an inner peripheral face configured for coupling to the pump shaft; and a buffer member configured for elastically abutting against an end of the spline shaft portion of the propeller shaft is provided between the spline hole and the fitting hole.

4. An impeller for a water jet pump in accordance with claim 1, further comprising a connecting grommet provided at an upstream tip end of the impeller configured for providing a more smooth transition between an outer peripheral face of the propeller shaft and an outer peripheral face of the tip portion of the impeller, to form a more continuous outer face in said transition.

* * * * *